United States Patent [19]

Barwasser

[11] Patent Number: 4,841,676

[45] Date of Patent: Jun. 27, 1989

[54] TURNING TOOL FOR MACHINING THE EDGES OF PLASTIC LENSES

[75] Inventor: Günter Barwasser, Neuss, Fed. Rep. of Germany

[73] Assignee: Wernicke & Co. GmbH, Düsseldorf, Fed. Rep. of Germany

[21] Appl. No.: 113,870

[22] Filed: Oct. 27, 1987

[30] Foreign Application Priority Data

Nov. 3, 1986 [DE] Fed. Rep. of Germany ... 8629226[U]

[51] Int. Cl.[4] ..... B24B 9/20

[52] U.S. Cl. ..... 51/181 R; 51/206 R; 408/2 T

[58] Field of Search ..... 51/181 R, 5 C, 5 B, 51/284 E, 284 R, 283 E, 206 R, 206 P, 170 PT, 170 R, 106 LG, 105 LG, 101 LG; 408/22–25, 27, 36

[56] References Cited

U.S. PATENT DOCUMENTS

| | | | |
|---|---|---|---|
| 3,513,598 | 5/1970 | Asselin et al. | 51/284 E |
| 3,828,648 | 8/1974 | Geula | 51/101 LG |
| 3,894,361 | 7/1975 | Georgiadis et al. | 51/101 LG |
| 4,171,926 | 10/1979 | Dusza | 144/218 |
| 4,179,851 | 12/1979 | Neisler et al. | 51/284 E |
| 4,434,588 | 3/1984 | Wada et al. | 51/181 R |

FOREIGN PATENT DOCUMENTS

| | | | |
|---|---|---|---|
| 2627258 | 12/1976 | Fed. Rep. of Germany | 408/22 |
| 2369907 | 7/1978 | France | 51/101 LG |
| 0089416 | 7/1981 | Japan | 408/22 |

*Primary Examiner*—Frederick R. Schmidt
*Assistant Examiner*—Robert A. Rose
*Attorney, Agent, or Firm*—Becker & Becker, Inc.

[57] ABSTRACT

A turning tool for machining the edges of plastic lenses in a machine for machining the edges of lenses. A grinding wheel is coaxially connected to a cutter in such a way that they both rotate together. The grinding wheel is provided with respective rough grinding, fine grinding, and bevelling portions.

5 Claims, 1 Drawing Sheet

TURNING TOOL FOR MACHINING THE EDGES OF PLASTIC LENSES

BACKGROUND OF THE INVENTION

The present invention relates to a turning tool for machining the edges of plastic spectacle lenses in a machine for machining the edges of lenses.

To machine the edges of plastic lenses to the desired circumference, cutting tools are used that preferably have a single cutting tooth, although they may also be provided with three cutting teeth. If the lens is made of soft yet tough material, such as a polycarbonate, the cutting tooth or cutting teeth leave transverse grooves on the edges of the lenses; these transverse grooves resemble marks made from stopping. These grooves are particularly prevalent after the cutter has been used for a long period of time. The occurrence of such transverse grooves is even more pronounced with the newer type of machines for machining the edges of lenses, because these machines provide for a cyclical turning of the template and the lens. A bevel is produced via a groove in the cutter that determines the circumference.

It is an object of the present invention to provide a turning tool that accelerates and simplifies machining of the periphery of a lens to the desired shape via structurally straightforward means.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

The turning tool of the present invention comprises a cutter, and a grinding wheel that is coaxially connected to the cutter in such a way that they both rotate together, with the grinding wheel being provided with respective rough grinding, fine grinding, and beveling portions.

The advantage of the tool of the present invention is that it is now possible to rapidly remove portions of the lens periphery until a certain dimension is reached, whereafter to achieve the final peripheral shape of the lens it is necessary to undertake only a brief grinding process.

Further specific features of the present invention will be described in detail subsequently.

DESCRIPTION OF PREFERRED EMBODIMENTS

Figure 1:
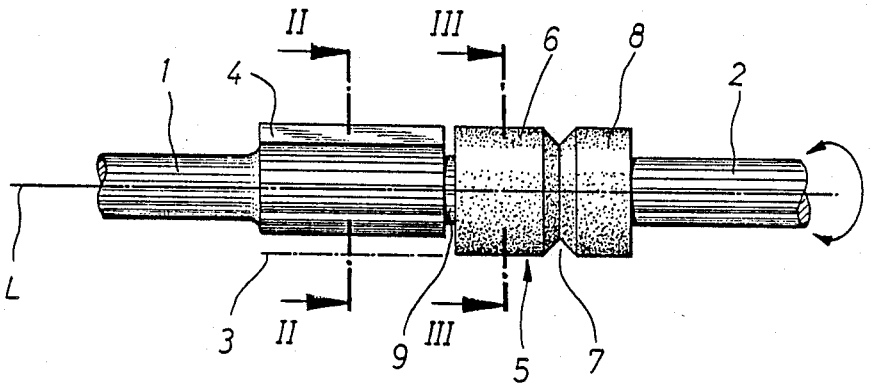
FIG. 1 is a side view of one exemplary embodiment of the inventive turning tool.
Figure 2:
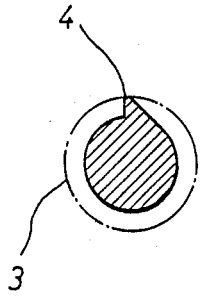
FIG. 2 is a cross-sectional view taken along the line II—II in FIG. 1.
Figure 3:
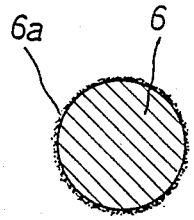
FIG. 3 is a cross-sectional view taken along the line III—III in FIG. 1.

Referring now to the drawing in detail, in the embodiment illustrated in FIG. 1 the inventive tool is provided with two spindle portions 1, 2 that are mounted in an edge-machining apparatus and are rotated about their longitudinal axis L. Disposed on, or connected with, the spindle portion 1 is a cutter 3 that is provided with one or more cutting teeth 4 that are parallel to the longitudinal axis L; in the illustrated embodiment, a single cutting tooth 4 is shown.

A grinding wheel 5, preferably a ceramic wheel, is disposed on or connected to the spindle portion 2. The grinding wheel 5 has a portion 6 that is provided with particles 6*a* of abrasive or grinding material for the preliminary or rough grinding of the periphery of the lens. Adjoining the grinding wheel portion 6 in the axial direction is a grinding wheel portion 7 that has a V-shaped groove for producing the bevel on the edge of the lens. Adjoining the bevel portion 7 of the grinding wheel 5 is a further grinding wheel portion or a further grinding wheel 8, which serves as a precision grinding wheel. The grinding wheels or portions 6, 7, 8 preferably have their adjacent end faces abutting one another, so that these portions represent a single grinding wheel 5 that is connected to the face-milling cutter 3 via an intermediate shaft or shaft portion 9, so that it is merely necessary to drive one of the two spindle portions 1 or 2 in order to rotate both the cutter 3 and the grinding wheel 5.

The cutter 3 has the same diameter, and hence the same circumference, as does the grinding wheel 5, as can be seen from FIG. 1. In the embodiment illustrated in FIG. 4, the distance "a" of the outer edge 4a of the cutting tooth 4 from the longitudinal axis L of the tool differs slightly from the diameter "b" of the grinding wheel 5 with its portions 6, 7, and 8. In the illustrated embodiment, the distance "a" is slightly less than the diameter "b".

The lens is first machined by the cutter 3 to a periphery that corresponds, or approximately corresponds, to that of a template or of the contour of a lens frame opening; in other words, a tolerance for the template size is allowed for. This cutting, especially of a plastic lens, takes place particularly rapidly and without difficulty. After the desired circumference, with tolerance, is achieved, the lens is transferred to the rough or coarse grinding wheel portion 6, where more of the periphery of the lens is removed, and the peripheral portions are smoothed and evened out. Thereafter, the fine grinding, and if desired the beveling, are effected on the grinding wheel portions 8 and 7 respectively of the grinding wheel 5.

Figure 4:
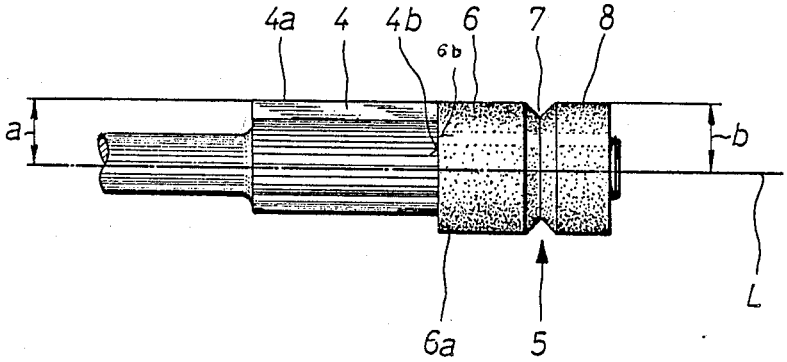
FIG. 4 is a side view of a second exemplary embodiment of the inventive turning tool.

In the embodiment illustrated in FIG. 4, the end faces 4*b* and 6*b* of the parts 4 and 6 rest against one another.

If it is necessary to cut with a different speed than is used for the grinding on the grinding wheel 5, this can be effected by regulating the speed of the drive mechanism for the spindles 1 or 2.

The present invention is, of course, in no way restricted to the specific disclosure of the specification and drawing, but also encompasses any modifications within the scope of the appended claims.

What I claim is:

1. A turning tool for machining the edges of plastic lenses in a machine for machining the edges of lenses made of soft yet tough material such as polycarbonate, said tool comprising:

a cutter having at least one cutter tooth that defines a predetermined rotational diameter so that the lens is first machined by said cutter to predetermined periphery; and a grinding wheel that is coaxially connected to said cutter in such a way that both said grinding wheel and said cutter rotate together with each other, with said grinding wheel being provided with respective rough grinding, fine grinding, and beveling portions along which the lens is transferred in linear progression respectively as a whole having a diameter substantially the same as said rotational diameter defined by said cutter tooth and with which peripheral portions of the plastic lens are smoothed and evened out to assure elimination of transverse grooves along the peripheral edges of the plastic lenses, said beveling portion being situated axially between said rough and fine grinding portions and comprising an annular groove.

2. A turning tool according to claim 1, in which said grinding wheel and said cutter rest directly against one another and are disposed on a common spindle.

3. A turning tool according to claim 1, in which said grinding wheel and said cutter are spaced slightly from one another and are disposed on two coaxial spindle segments along a common spindle axis.

4. A turning tool according to claim 1, in which said cutter has a single cutting tooth and has a cutting circumference that corresponds at least approximately to the circumference of said grinding wheel.

5. A turning tool according to claim 1, in which said cutter has three cutting teeth and has a cutting circumference that corresponds at least approximately to the circumference of said grinding wheel.

* * * * *